United States Patent [19]

Ellis

[11] Patent Number: 4,801,522

[45] Date of Patent: Jan. 31, 1989

[54] PROCESS FOR PREPARING A PHOTOGRAPHIC EMULSION CONTAINING TABULAR GRAINS EXHIBITING HIGH SPEED

[75] Inventor: Charles D. Ellis, Hendersonville, N.C.

[73] Assignee: E. I. Du Pont de Nemours and Company, Wilmington, Del.

[21] Appl. No.: 171,233

[22] Filed: Mar. 23, 1988

Related U.S. Application Data

[63] Continuation-in-part of Ser. No. 917,505, Oct. 10, 1986, abandoned.

[51] Int. Cl.[4] ..... G03C 1/02

[52] U.S. Cl. ..... 430/569; 430/567; 430/570; 430/960; 430/967

[58] Field of Search ..... 430/567, 569, 966, 967, 430/570

[56] References Cited

U.S. PATENT DOCUMENTS

| | | | |
|---|---|---|---|
| 4,386,156 | 5/1983 | Mignot | 430/569 |
| 4,414,310 | 11/1983 | Daubendick et al. | 430/567 |
| 4,425,425 | 1/1984 | Abbott et al. | 430/502 |
| 4,434,226 | 2/1984 | Wilgus et al. | 430/567 |
| 4,647,528 | 3/1987 | Yamada et al. | 430/569 |
| 4,665,012 | 5/1987 | Sugimoto et al. | 430/502 |

*Primary Examiner*—Mukund J. Shah

[57] ABSTRACT

Process for preparing a photographic emulsion containing tabular silver halide grains, which exhibit high speed upon sensitization, having a thickness of about 0.05 to 0.5 μm, average grain volume of about 0.05 to 1.0 $\mu m^3$ and mean aspect ratio of greater than 2:1 comprising A. adding silver nitrate to a vessel containing dispersing medium/bromide mixture, initial bromide ion concentration 0.08 to 0.25 N, to form tabular seed grains;

B. adding an ammoniacal base solution, to achieve 0.002 to 0.2 normal of the base (e.g., after at least 2% of total silver nitrate has been added); and C. adding additional silver nitrate and halide, e.g., $Br^-$ or $BrI^-$, by balanced double jet procedure. The emulsions are used in photographic elements for x-ray, graphic arts, etc.

18 Claims, No Drawings

PROCESS FOR PREPARING A PHOTOGRAPHIC EMULSION CONTAINING TABULAR GRAINS EXHIBITING HIGH SPEED

This application is a continuation-in-part of application Ser. No. 917,505 filed Oct. 10, 1986, now abandoned.

DESCRIPTION

TECHNICAL FIELD

This invention relates to a process for preparing a photographic emulsion containing tabular silver halide grains. More particularly this invention relates to a process for preparing a photographic emulsion wherein the tabular silver halide grains exhibit high speed upon sensitization.

BACKGROUND OF THE INVENTION

Tabular silver halide grains, their preparation and use in photographic emulsions, are widely known. They have been extensively studied in the literature since photographic emulsions containing these grains appeared to offer some significant advantages over photographic emulsions containing round or globular grains (e.g., splash prepared types). Generally, tabular grains are large, flat silver halide grains that are prepared by employing long ripening times or by balanced double jet (BDJ) precipitation methods. Commercial emulsions using tabular grains are conventionally made by using a BDJ process. The tabular grains usually have triangular parallel crystal faces each of which is usually larger than any other crystal face of the grain and are conventionally defined by their aspect ratio (AR) which is the ratio of the diameter of the grain to the thickness. Larger AR grains, e.g., at least 8:1, have diameters of at least 0.6 μm and thicknesses of less than 0.3 μm. These larger tabular grains have certain commercial advantages apparent to those of normal skill in the art. For example, they have a larger surface area and thus can accept more sensitizing dye. Since these tabular grains usually are dye sensitized, when emulsions using such tabular grains are present in medical x-ray elements an increase in sharpness can result. In addition, since the tabular grains normally lie flat when coated from an emulsion on a support, the covering power is usually greater and thus the emulsion can be coated at a lower coating weight and is therefore less costly. It is desired to prepare photographic emulsions containing tabular grains exhibiting high speed.

SUMMARY OF THE INVENTION

In accordance with this invention there is provided a process for the preparation of a photographic emulsion containing tabular silver halide grains, which exhibit high speed upon sensitization, having a thickness of about 0.05 to 0.5 μm, average grain volume of about 0.05 to 1.0 $\mu m^3$, and a mean aspect ratio of greater than 2:1 comprising A. adding silver nitrate to a vessel containing a dispersing medium/bromide mixture wherein the initial bromide ion concentration is 0.08 to 0.25 normal whereby tabular seed grains are formed;

B. adding an ammoniacal base solution to achieve 0.002 to 0.2 normal of the base after at least 2 % of the total silver nitrate has been added to the vessel; and C. adding silver nitrate and halide taken from the group consisting of $Br^-$ and $BrI^-$ by balanced double jet procedure thereby tabular grains are formed.

DETAILED DESCRIPTION OF THE INVENTION

The process of this invention results in photographic emulsions containing tabular silver halide grains which are higher in speed when compared to tabular grains prepared according to known processes. The resultant high speed could not have been predicted from the state of the art. It is also possible that the tabular silver halide grains can be prepared having a narrow size distribution as taught in Nottorf, U.S. patent application Ser. No. 917,504, filed concurrently herewith entitled "Process For Preparing A Photographic Emulsion Containing Tabular Grains Having Narrow Size Distribution, now U.S. Pat. No. 4,722,886. The narrow size distribution is achieved by using a silver halide solvent such as ammonia, ammonia derivatives, etc., and by stopping 1he initial silver nitrate addition for a time period of 1 to 60 minutes at a bromide ion concentration in the range of 0.005 to 0.05 normal (N).

The excess ammoniacal base present upon completion of the final addition of silver nitrate and halide can be neutralized with acid. Substantially no neutralization of the base in the present invention occurs prior to completion of the final addition of silver nitrate and halide. Optionally the neutralized emulsion containing the final tabular grains may be ripened further by the addition of a thiocyanate salt ripening agent. e.g. alkali metal thiocyanate, for a period of about 1 to 20 minutes. The speed advantage of the emulsion is achieved after it has been chemically and spectrally sensitized by procedures known to those skilled in the art. The thinner grains exhibit higher speed.

The tabular silver halide grains which upon sensitization exhibit high speed are of the silver bromide or silver bromoiodide types. The grains have an average thickness of about 0.05 to 0.5 μm, preferably 0.05 to 0.2 μm and more preferably 0.1 μm or below; an average grain volume of 0.05 to 1.0 $\mu m^3$, preferably 0.1 to 0.3 μm; and a mean aspect ratio of greater than 2:1 , preferably greater than 5:1, and more preferably greater than 8:1.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each grain. From this the aspect ratio of each tabular grain can be calculated, and the aspect ratios of all the tabular grains in the sample can be averaged to obtain their mean aspect ratio. By this definition the mean aspect ratio is the average of individual tabular grain aspect ratios. In practice it is usually simpler to obtain an average thickness and an average diameter of the tabular grains having a thickness of less than 0.5 μm and to calculate the mean aspect ratio as the ratio of these two averages. Whether the averaged individual aspect ratios or the averages of thickness and diameter are used to determine the mean aspect ratio, within the tolerances of grain measurements contemplated, the mean aspect ratios obtained do not significantly differ. The average grain volume of a tabular grain is determined as taught by Holland et al. PS and E, volume 17, No. 3 (1973), Page 295 et seq. Normally these determinations are made using tabular grains which are in the grain diameter range of 0.5 to 2.5 μm and appear tabular at 2,500 times magnification.

In the preparation of the tabular grains described above the following procedure is used. Into a conventional reaction vessel for silver halide precipitation equipped with a stirring mechanism is introduced a dispersing medium/bromide mixture wherein the initial bromide ion concentration is 0.08 to 0.25N, which is the known range to produce tabular grains. Preferably the bromide ion concentration is 0.1 to 0.2N. The bromide salt present is typically in the form of an aqueous salt solution, e.g., one or more soluble ammonium, alkali metal, e.g., sodium, potassium; alkaline earth metal, e.g., magnesium or calcium. Suitable dispersing media initially present in the reaction vessel include water and a peptizer. e.g., gelatin including alkali-treated gelatin (cattle bone or hide gelatin), acid-treated gelatin (pigskin gelatin), gelatin derivatives, e.g., acetylated gelatin, phthalated gelatin, etc.; proteins, protein derivatives, cellulose derivatives, e.g., cellulose esters; polysaccharides, e.g., dextran, gum arabic, zein, casein, pectin, collagen derivatives, agar-agar, arrowroot, albumin, etc. Mixtures of peptizers may be used. A preferred peptizer is gelatin or a gelatin derivative.

Other materials commonly employed in combination with hydrophilic colloid peptizers as vehicles (including vehicle extenders, e.g., materials in the form of latices) include synthetic polymeric peptizers, carriers and/or binders such as poly(vinyl lactams) acrylamide polymers, polyvinyl alcohol and its derivatives polyvinyl acetals, polymers of alkyl and sulfoalkyl acrylates and methacrylates, hydrolyzed polyvinyl acetates, polyamides, polyvinyl pyridine acrylic acid polymers maleic anhydride copolymers polyalkylene oxides methacrylamide copolymers, maleic acid copolymers, vinylamine copolymers, methacrylic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides, etc. These additional materials need not be present in the reaction vessel during silver halide precipitation, but can be added to the emulsion prior to coating on a support. The temperature of the contents in the reaction vessel is preferably in the range of 40° to 80° C. Silver nitrate is then added at a steady rate into the reaction vessel containing the dispersing medium/bromide mixture whereby tabular seed grains begin to form.

After approximately at least 2 percent of the total silver nitrate has been added to ensure proper size tabular seed grains have been permanently formed, an ammoniacal base solution is added to the reaction vessel to achieve about 0.002 to 0.2N, preferably 0.002 to 0.1N, of the base in the vessel.

Upon achieving a desired bromide ion concentration in the reaction vessel, silver nitrate is continually added into the vessel together with a halide compound which introduces additional bromide ions or bromoiodide ions by a balanced double jet (BDJ) procedure known to those skilled in the art thereby maintaining the desired bromide ion concentration. It is in this step that the tabular grains achieve the desired properties including mean aspect ratio. In the event that bromoiodide ions are added during the BDJ procedure, the amount of iodide present in the emulsion is in the range of about 0.01 to 10.0 mol percent, preferably 0.01 to 2.0 mol percent based on total silver.

As stated above and in order to specifically control the grain size distribution, when the desired bromide ion concentration in the range of 0.005 to 0.05N is achieved, and in the presence of a silver halide solvent, e.g., ammonia, ammonia derivative, etc., the initial silver nitrate addition optionally may be stopped for a period of time in the range of 1 to 60 minutes.

After completion of the total silver nitrate and halide addition by the BDJ procedure, any excess basic solution present in the emulsion optionally can be neutralized with acid, e.g., acetic acid, sulfuric acid, nitric acid, hydrochloric acid, etc. The PH achieved is in the range of about 5.0 to 7.0. preferably about 6.0. At this stage, the tabular grains may be further ripened for a time period of 1 to 20 minutes by the addition of a thiocyanate salt to the emulsion. Useful thiocyanate salts include alkali metal thiocyanates and ammonium thiocyanate, e.g., in an amount of 0.1 to 20 g salt/mole silver halide. Other ripening agents include thioether, etc., as well as others known to those skilled in the art.

The tabular grain emulsions are preferably washed to remove soluble salts. Washing techniques are known to those skilled in the art. The washing is advantageous in terminating ripening of the tabular grains after completion of precipitation to avoid increasing their thickness and reducing their aspect ratio. While substantially all the grains are tabular in form the emulsion is not affected by the presence of a minor amount of nontabular grains. Tabular grains of any aspect ratio can be made according to the described process; for example, large, thin tabular grains or, alternatively, thicker, smaller tabular grains can be prepared.

The emulsion containing tabular grains prepared according to this invention is generally fully dispersed and bulked up with gelatin or other dispersion of peptizer described above and subjected to any of the known methods for achieving optimum sensitivity whereby the high speed of the tabular silver halide grains is achieved. Preferably optimum chemical sensitization is achieved by the addition of sulfur and gold. Other sensitizers include: selenium, tellurium, platinum, palladium, iridium, osmium, rhodium rhenium or phosphorous sensitizers or combinations thereof at $10^{-8}$ to $10^{-10}$N silver (pAg B to IO) pH of 6.0 to 7.0 and temperatures of from 50° to 60° C. Chemical sensitization can occur in the presence of modifiers, e.g., compounds known to suppress fog and increase speed when present during chemical sensitization, such as azaindenes, azapyridazines, azapyrimidines, benzothiazolium salts, and sensitizers having one or more heterocyclic nuclei. The tabular grain silver halide emulsions are also spectrally sensitized. Useful sensitizing dyes are those dyes that exhibit absorption maxima in the blue and minus blue (i.e., green and red) portions of the visible spectrum. In addition for specialized applications, spectral sensitizing dyes can be employed which have improved spectral response beyond the visible spectrum, e.g., infrared absorbing spectral sensitizers. Examples of those disclosed in U.S. Pat. No. 4,425,426 col. 16, line 52 to col. 19, line 42 which is incorporated herein by reference.

The tabular grain emulsions are useful in photographic film elements. An emulsion can be coated in the normal manner on any of the conventional supports, e.g., preferably polyethylene terephthalate subbed in a conventional manner. Any of the other supports known to the art can also be used. Coating, wetting aides, antifoggants, antistatic agents, etc., common to most silver halide elements, can also be used in the preparation of the film elements.

Since elements prepared from the emulsions made using the process of this invention are eminently suitable for use in x-ray elements, usually the elements are coated on both sides of the support which usually is tinted with a blue dye as is known to those skilled in the x-ray art. The support may, and preferably does, have the conventional resin-type sub applied to the support and the sublayer is then usually overcoated with a thin substratum of gelatin over which the emulsion is then applied. The emulsion may be applied at coating weights of less than 5 g $Ag/m^2$, preferably less than 4 g $Ag/m^2$, for example, and then an abrasion layer of hardened gelatin applied thereto to provide protection for the silver containing layers. This element is conventionally exposed in a typical cassette with a pair of x-ray intensifying screens as is well known. Of course, this is only a preferred element employing emulsions of this invention. The emulsion can be used conveniently in any of the well-known photosensitive systems as noted below. A preferred mode of the invention is described in Example 5.

INDUSTRIAL APPLICABILITY

Photographic silver halide film elements having at least one layer of an emulsion containing the high speed tabular silver halide grains prepared according to the process of this invention are useful in conventional areas of photography. The photographic elements are particularly useful as x-ray films, e.g., support coated on each side, in cooperation with x-ray intensifying screens. Sensitization can be in the green or blue portion of the spectrum. Other uses include: graphic arts films, color photographic films, etc.

EXAMPLES

The following examples illustrate but do not limit the invention. In the Control and Examples the percentages are by weight. N means normal.

CONTROL 1

To 450 liters of a well-stirred aqueous solution, which contained 1.6 percent photographic gelatin and 9.1 kilograms of potassium bromide and which was maintained at 60° C., was added a 1N $AgNO_3$ solution at constant flow until the bromide ion concentration was lowered to 0.075N. Double-jet addition of a 3N $AgNO_3$ solution and a 3N KBr solution was then initiated with the $AgNO_3$ flow increasing 200 ml/min/min for 20 minutes and the KBr flow increasing to maintain a growth bromide ion concentration of 0.075N. The KBr solution was halted and the $AgNO_3$ solution continued at a constant flow until the bromide ion concentration was lowered to 0.025N, which was then maintained by double-jet addition of KBr and $AgNO_3$ at constant flow until 540 moles of $AgNO_3$ was dispensed. Following precipitation, 675 grams of sodium thiocyanate were added and the emulsion ripened at 60° C. for 15 minutes. The emulsion was then cooled to 40° C. and washed by a coagulation process three times.

The resultant tabular grain AgBr emulsion had an average grain volume of 0.16 $\mu m^3$, an average grain thickness of 0.10 $\mu m$ and an average AR of 14:1.

EXAMPLE 1

To 550 liters of a well-stirred aqueous solution, which contained 1.6 percent photographic gelatin and 11.1 kilograms of potassium bromide and which was maintained at 60° C., was added a 3N $AgNO_3$ solution at constant flow. When the bromide ion concentration was lowered to 0.058N, 1210 grams of a 23 percent ammonia solution were added. The $AgNO_3$ flow continued until the bromide ion concentration was lowered to 0.020N, at which time the $AgNO_3$ solution was halted. After 3 minutes double-jet addition of a 3N $AgNO_3$ solution and a 3N KBr solution was initiated, with the $AgNO_3$ flow increasing 387 ml/min/min for 15 minutes and the KBr flow increasing to maintain a growth bromide ion concentration of 0.020N. Double-jet addition continued at constant flow until 660 moles of $AgNO_3$ were dispensed. Following precipitation, 925 grams of glacial acetic acid were first added to neutralize all remaining ammonia and then 825 grams of sodium thiocyanate were added and the emulsion ripened at 60° C. for 15 minutes. The emulsion was then cooled to 40° C. and washed by a coagulation process three times.

The resultant tabular grain AgBr emulsion had an average grain volume of 0.09 $\mu m^3$, an average grain thickness of 0.15 $\mu m$ and an average AR of 6:1.

EXAMPLE 2

To 550 liters of a well-stirred aqueous solution, which contained 1.6 percent photographic gelatin and 11.1 kilograms of potassium bromide and which was maintained at 60° C., was added a 3N $AgNO_3$ solution at constant flow. When the bromide ion concentration was lowered to 0.058N, 3226 grams of a 23 percent ammonia solution were added. The $AgNO_3$ flow continued until the bromide ion concentration was lowered to 0.010N, at which time the $AgNO_3$ solution was halted. After 3 minutes double-jet addition of a 3N $AgNO_3$ solution and a 3N KBr solution was initiated, with the $AgNO_3$ flow increasing 413 ml/min/min for 15 minutes and the KBr flow increasing to maintain a growth bromide ion concentration of 0.010N. Double-jet addition continued at constant flow until 660 moles of $AgNO_3$ were dispensed. Following precipitation, 2440 grams of glacial acetic acid were first added to neutralize all remaining ammonia and then 825 grams of sodium thiocyanate were added and the emulsion ripened at 60° C. for 15 minutes. The emulsion was then cooled to 40° C. and washed by a coagulation process three times.

The resultant tabular grain AgBr emulsion had an average grain volume of 0.13 $\mu m^3$, an average grain thickness of 0.35 $\mu m$ and an average AR of 2:1.

The emulsions of Control 1 and Examples 1 and 2 were chemically sensitized with sulfur and gold and spectrally sensitized to the green portion of the spectrum with 1.3 g/Ag mole of anhydro-9-ethyl-5,5'-dichloro-3,3'-bis(4-sulfobutyl)oxacarbocyanine hydroxide, triethylamine salt sensitizing dye and 0.2 g/Ag mole of potassium iodide. The sensitized emulsions were coated on both sides of a polyethylene terephthalate film support and given a 60 kVp, 100 mA, 40 ms exposure 40 inches (101.6 cm) from a standard tungsten x-ray source through a oontinuous aluminum stepwedge and through a standard green light emitting screen such as Du Pont Quanta ®V and processed in a conventional radiographic element processor. Du Pont QC-IRT, using a standard developer solution, Du Pont HSD.

The properties of the resultant images are summarized in Table 1 below.

TABLE 1

| Cont. or Ex. No. | Basic Growth | Grain Thick. (μm) | Grain Vol. ($\mu m^3$) | AR | Rel. Speed | PER Speed[1] |
|---|---|---|---|---|---|---|
| C1 | No | 0.10 | 0.16 | 14:1 | 225 | 100 |
| E1 | Yes | 0.15 | 0.09 | 6:1 | 245 | 175 |
| E2 | Yes | 0.35 | 0.13 | 2:1 | 260 | 140 |

[1]Projected Equivolume Relative (PER) Speed is the average of the speed Predicted by assuming speed is proportional to volume and that predicted by assuming speed is proportional to volume to the $\frac{2}{3}$.

EXAMPLE 3

To 4.375 liters of a well-stirred aqueous solution, which contained 1.6 percent photographic gelatin and 88.51 grams of potassium bromide and which was maintained at 60° C., was added a 3N $AgNO_3$ solution at constant flow. When the bromide ion concentration was lowered to 0.058N, 3.8 mls of a 23 percent ammonia solution were added. The $AgNO_3$ flow continued until the bromide ion concentration was lowered to 0.010N, at which time double-jet addition of a 3N $AgNO_3$ solution and a 3N KBr solution was initiated, with the $AgNO_3$ flow increasing 3.0 ml/min/min for 15 minutes and the KBr flow increasing to maintain a growth bromide ion concentration of 0.010N. Double-jet addition continued at constant floW until 5.25 moles of $AgNO_3$ were dispensed. Following precipitation, glacial acetic acid was first added to neutralize all remaining ammonia and then 6.55 grams of sodium thiocyanate were added and the emulsion ripened at 60° C. for 15 minutes. The emulsion was then cooled to 40° C. and washed by a coagulation process three times.

The resultant tabular grain AgBr emulsion had an average grain volume of 0.11 $\mu m^3$, an average grain thickness of 0.15 μm and an average AR of 6:1.

EXAMPLE 4

To 4.375 liters of a well-stirred aqueous solution, which contained 1.6 percent photographic gelatin and 88.51 grams of potassium bromide and which was maintained at 60° C., was added a 3N $AgNO_3$ solution at constant flow. When the bromide ion concentration was lowered to 0.058N, 9.4 mls of a 23 percent ammonia solution were added. The $AgNO_3$ flow continued until the bromide ion concentration was lowered to 0.020N, at which time the $AgNO_3$ solution was halted. After 3 minutes double-jet addition of a 3N $AgNO_3$ solution and a 3N KBr solution was initiated, with the $AgNO_3$ flow increasing 3.0 ml/min/min for 15 minutes and the KBr flow increasing to maintain a growth bromide ion concentration of 0.020N. Double-jet addition continued at constant flow until 5.25 moles of $AgNO_3$ were dispensed. Following precipitation, glacial acetic acid was first added to neutralize all remaining ammonia and then 6.55 grams of sodium thiocyanate were added and the emulsion ripened at 60° C. for 15 minutes. The emulsion was then cooled to 40° C. and washed by a coagulation process three times.

The resultant tabular grain AgBr emulsion had an average grain volume of 0.15 $\mu m^3$, an average grain thickness of 0.15 μm, and an average AR of 7:1.

EXAMPLE 5

To 4.375 liters of a well-stirred aqueous solution, which contained 1.6 percent photographic gelatin and 88.51 grams of potassium bromide and which was maintained at 60° C., was added a 3N $AgNO_3$ solution at constant flow. When the bromide ion concentration was lowered to 0.058N, 7.0 mls of a 23 percent ammonia solution were added. The $AgNO_3$ flow continued until the bromide ion concentration was lowered to 0.040N, at which time the $AgNO_3$ solution was halted. After 3 minutes double-jet addition of a 3N $AgNO_3$ solution and a 3N KBr solution was initiated, with the $AgNO_3$ flow increasing 3.2 ml/min/min for 15 minutes and the KBr flow increasing to maintain a growth bromide ion concentration of 0.040N. Double-jet addition continued at constant flow for 14 minutes, at which time the KBr solution was halted and the $AgNO_3$ solution continued at constant flow until the bromide ion concentration was lowered to 0.015N, which was then maintained by double-jet addition of KBr and $AgNO_3$ at constant flow until 5.25 moles of $AgNO_3$ was dispensed. Following precipitation, glacial acetic acid was first added to neutralize all remaining ammonia and then 6.55 grams of sodium thiocyanate were added and the emulsion ripened at 60° C. for 15 minutes. The emulsion was then cooled to 40° C. and washed by a coagulation process three times.

The resultant tabular grain AgBr emulsion had an average grain volume of 0.23 $\mu m^3$, an average grain thickness of 0.10 μm, and an average AR of 17:1.

The emulsions of Examples 3 to 5 were chemically sensitized, spectrally sensitized, coated single side on a support, and exposed as described prior to Table 1.

The properties of the resultant images are summarized in Table 2 below.

TABLE 2

| Ex. No. | Halt Ripening | Grain Thick. (μm) | Grain Vol. ($\mu m^3$) | AR | Rel. Speed | PER Speed[1] |
|---|---|---|---|---|---|---|
| E3 | no | 0.15 | .11 | 6:1 | 250 | 100 |
| E4 | yes | 0.15 | .15 | 7:1 | 335 | 105 |
| E5 | yes | 0.10 | .23 | 17:1 | 600 | 130 |

[1]Projected Equivolume Relative (PER) Speed is the average of the speed predicted by assuming speed is proportional to volume and that predicted by assuming speed is proportional to volume to the $\frac{2}{3}$.

I claim:

1. A process for the preparation of a photographic emulsion containing tabular silver halide grains, which exhibit high speed upon sensitization, having a thickness of about 0.05 to 0.5 μm, average grain volume of about 0.05 to 1.0 $\mu m^3$, and a mean aspect ratio of greater than 2:1 comprising A. Adding silver nitrate to a vessel containing a dispersing medium/bromide mixture wherein the initial bromide ion concentration is 0.08 to 0.25 normal whereby tabular seed grains are formed;

B. adding an ammoniacal base solution to achieve 0.002 to 0.2 normal of the base after at least 2% of the total silver nitrate has been added to the vessel; and C. adding silver nitrate and halide selected from the group consisting of $Br^-$ and $BrI^-$ by balanced double jet procedure whereby tabular grains are formed.

2. A process according to claim 1 wherein when the bromide ion concentration is in the range of 0.005 to 0.05N, the initial silver nitrate addition is stopped for a time period of 1 to 60 minutes.

3. A process according to claim 1 wherein after Step C the excess base is neutralized with acid.

4. A process according to claim 3 wherein a thiocyanate salt ripening agent is added and the emulsion is then ripened for 1 to 20 minutes.

5. A process according to claim 1 wherein the emulsion is chemically and spectrally sensitized.

6. A process for the preparation of a photographic emulsion containing tabular silver halide grains, which exhibit high speed upon sensitization, having a thickness of about 0.5 to 0.2 μm, average grain volume of about 0.1 to 0.3 $\mu m^3$, and a mean aspect ratio greater than 8:1 comprising A. adding silver nitrate to a vessel containing a gelatino/bromide mixture wherein the initial bromide ion concentration is 0.1 to 0.2N whereby tabular seed grains are formed;

B. adding an ammoniacal base solution to achieve 0.002 to 0.1 normal of the base after at least 2% of the total silver nitrate has been added to the vessel; and C. adding silver nitrate and halide selected from the group consisting of $Br^-$ and $BrI^-$ by balanced double jet procedure whereby tabular grains are formed.

7. A process according to claim 6 wherein when the bromide ion concentration is in the range of 0.005 to 0.05N, the initial silver nitrate addition is stopped for a time period of 1 to 60 minutes.

8. A process according to claim 6 wherein after Step C the excess base is neutralized with acid.

9. A process according to claim 8 wherein a thiocyanate salt ripening agent is added and the emulsion is then ripened for 1 to 20 minutes.

10. A process according to claim 6 wherein the emulsion is chemically and spectrally sensitized.

11. A photographic film element comprising a support having coated thereon at least one silver halide emulsion prepared according to claim 1.

12. A photographic film element comprising a support having coated thereon at least one silver halide emulsion prepared according to claim 5.

13. A photographic film element comprising a support having coated thereon at least one silver halide emulsion prepared according to claim 6.

14. A photographic film element comprising a support having coated thereon at least one silver halide emulsion prepared according to claim 10.

15. A photographic film element according to claim 11 wherein the support is coated on each side with a layer of said silver halide emulsion.

16. A photographic film element according to claim 12 wherein the support is coated on each side with a layer of said silver halide emulsion.

17. A photographic film element according to claim 13 wherein the support is coated on each side with a layer of said silver halide emulsion.

18. A photographic film element according to claim 14 wherein the support is coated on each side with a layer of said silver halide emulsion.

* * * * *

UNITED STATES PATENT AND TRADEMARK OFFICE

CERTIFICATE OF CORRECTION

PATENT NO. : 4,801,522

DATED : JAN. 31, 1989

INVENTOR(S) : ELLIS

It is certified that error appears in the above-identified patent and that said Letters Patent is hereby corrected as shown below:

Column 9, line 17, "0.5" should be --0.05--.

Signed and Sealed this

Eighteenth Day of July, 1989

*Attest:*

*Attesting Officer*

DONALD J. QUIGG

*Commissioner of Patents and Trademarks*